United States Patent [19]

Jeng

[11] 4,437,567

[45] Mar. 20, 1984

[54] STERILE PACKAGE AND METHOD OF MAKING

[75] Inventor: David K. H. Jeng, Lake Zurich, Ill.

[73] Assignee: The Kendall Company, Boston, Mass.

[21] Appl. No.: 343,320

[22] Filed: Jan. 27, 1982

[51] Int. Cl.[3] ..... B65D 81/28; A61L 2/18

[52] U.S. Cl. ..... 206/210; 206/812; 422/28

[58] Field of Search ..... 206/210, 812; 422/28

[56] References Cited

U.S. PATENT DOCUMENTS

| | | | |
|---|---|---|---|
| 1,139,774 | 5/1915 | Knox . | |
| 1,885,133 | 11/1932 | Oppenheimer | 206/812 |
| 1,953,526 | 4/1934 | Ainslie et al. . | |
| 2,699,779 | 1/1955 | Lustig | 206/210 |
| 2,923,664 | 2/1960 | Cook et al. | 206/210 |
| 3,129,811 | 4/1964 | Williams | 206/812 |
| 3,240,326 | 3/1966 | Miller | 206/812 |
| 3,264,188 | 8/1966 | Gresham | 206/812 |
| 3,399,955 | 9/1968 | Zimmerman | 422/28 |
| 3,414,927 | 12/1968 | Worcester | 206/812 |
| 3,485,349 | 12/1969 | Chaney, Jr. | 206/812 |
| 3,786,615 | 1/1974 | Bauer | 206/812 |
| 4,169,124 | 9/1979 | Forstrom et al. | 422/28 |
| 4,289,728 | 9/1981 | Peel et al. | 422/28 |

*Primary Examiner*—William T. Dixson, Jr.
*Assistant Examiner*—Brenda J. Ehrhardt

[57] ABSTRACT

Sterilization of packaged products for medical or surgical use by including in the package aqueous hydrogen peroxide at a concentration of 0.01 to 0.10% by weight.

6 Claims, 2 Drawing Figures

FIG 1
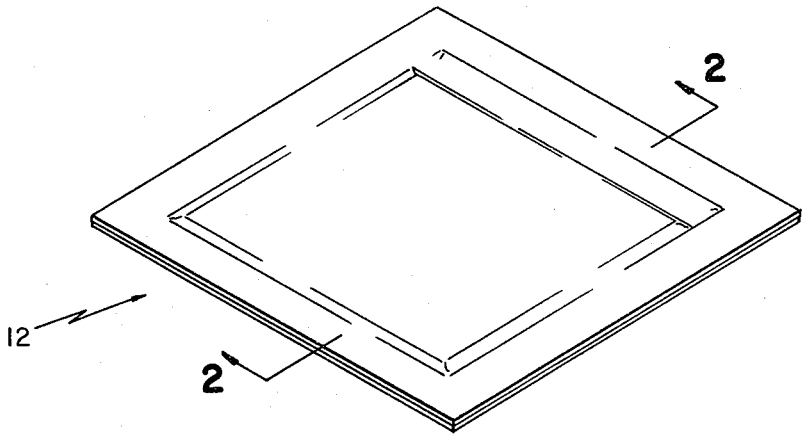
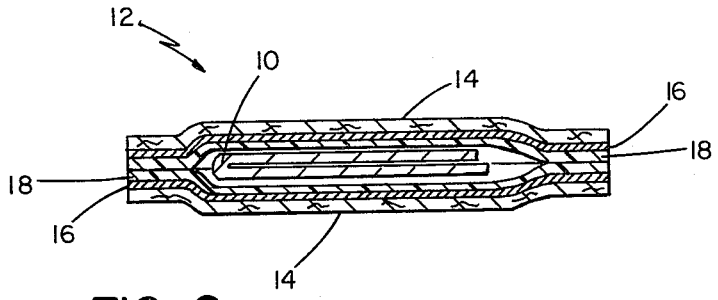
FIG 2

STERILE PACKAGE AND METHOD OF MAKING

This invention relates to sterilization of sealed packaged products during storage at room temperature or at elevated temperature, particularly products for medical or surgical use, including such products as dressings, skin wipes, contact lenses, cardioventricular valves and similar prostheses, kidney dialysis liquids, irrigation liquids such as saline solutions, and the like.

It has previously been customary to sterilize products in sealed packages during storage by including ethylene oxide within the package; however, the use of ethylene oxide presents an atmospheric pollution and health hazard both during the manufacturing of the sealed package and during the use of the product when the package is opened. Although aqueous hydrogen peroxide in concentrations upwards of 3% has been employed in packages which are heated at elevated temperature at the time of filling and sealing the packages, low concentrations of hydrogen peroxide have generally been considered ineffective for sterilization. However, in the case of products for medical or surgical use in contact with skin or tissue, the presence of aqueous hydrogen peroxide in a concentration higher than about 0.1% causes irritation and/or a burning sensation when it comes in contact with skin or tissue.

It has now been found that effective sterilization of products in hermetically sealed packages can be achieved by incorporating within the package a solution containing 0.01 to 0.1% by weight hydrogen peroxide in an inert liquid solvent such as a lower alcohol, physiological saline solution, or water, and allowing the package to stand at a temperature at least as high as room temperature for at least about fifteen days. Consequently, sterilization of the package contents can occur during normal storage and/or transportation before use by the customer. When concentrations of hydrogen peroxide are lower than 0.1%, longer times are required for complete sterilization at room temperature; for example, at a concentration of 0.025% peroxide about 25 days is required at 25° C. for complete sterilization, and several additional days are required if the temperature is maintained at 20° C. Shorter times are required at higher temperatures, only ten days being required at 90° C. even at a concentration as low as 0.01%, and less than one day being needed at 60° C. at a concentration of 0.1%. Selection of the concentration, temperature and time can be adjusted as desired in the light of the foregoing. In a preferred embodiment, the package includes a solution containing from 0.05 to 0.1% hydrogen peroxide by weight, which in the case of the minimum concentration requires at least 15 days at 25° C. to reach complete sterilization or at least two days at 50° C.; or which in the case of the maximum concentration requires at least 6 days at 25° C. or at least one day at 50° C.

Usually the solvent is aqueous, being water or a water-alcohol mixture. In the case of products such as irrigation liquids for irrigating bodily cavities, e.g., normal saline, the hydrogen peroxide can be dissolved in the product itself in the specified concentration. Products sterilized in accordance with the present invention can be used in contact with skin or tissue immediately after opening the sealed package without producing any irritation or burning.

The package itself can be fabricated or any conventional material such as plastic coated metal, glass, plastic film or sheet, plastic coated metal foil or metallized paper, or other packaging material impervious to liquid and inert to the contents. The amount of hydrogen peroxide solution within the package is not critical; enough to wet the entire exposed surface of the product to be sterilized will suffice, but an excess is generally not harmful.

While any product can be sterilized according to the present invention, the invention is particularly advantageous when applied to products for medical or surgical use in contact with skin or tissue, e.g., wet dressings and skin wipes.

In order to illustrate more fully the present invention, one embodiment is shown in the drawing, in which FIG. 1 is an isometric view showing a sealed packaged product as one embodiment of the invention; and FIG. 2 is a view in section taken along line 2—2 of FIG. 1.

In the drawing, the product 10 is a folded cotton fibrous web saturated with physiological saline intended for use as a wet dressing; and the package 12 is an envelope consisting of paper base sheets 14, 14 having laminated or bonded to their inner faces a continuous layer of liquid impervious metal foil 16, 16 and plastic inner coating 18, 18. The two laminated sheets are bonded together along their margins by a suitable adhesive to form a hermetically sealed package. Before sealing there is dissolved in the saline approximately 0.05% by weight, based on the total saline solvent, of hydrogen peroxide. After two days' storage at 50° C., the product is completely sterile.

In use, the package is opened by manually tearing off one end of package 12 and the product 10 is used immediately after removal from the package as a wet dressing. No skin irritation or burning sensation is caused by its use.

What is claimed is:

1. The method of sterilizing a product which comprises placing the product incorporating in the package a first sterilization medium comprising a solution containing 0.01 to 0.1% by weight of hydrogen peroxide in an inert liquid solvent in the absence of a second sterilizing medium, hermetically sealing said package, and allowing said package to stand at a temperature at least as high as room temperature for a time sufficient to provide complete sterilization of the contents of said package.

2. The method as claimed in claim 1 in which said product is for medical or surgical use in contact with skin or tissue and said solvent is aqueous.

3. The method as claimed in claim 1 or 2 in which said solution contains 0.05 to 0.1% by weight of hydrogen peroxide.

4. A hermetically sealed package containing a sterile product together with a first sterilizing medium comprising a solution containing 0.01 to 0.1% hydrogen peroxide by weight in an inert liquid solvent in the absence of a second sterilizing medium.

5. A package as claimed in claim 4 in which said product is for medical or surgical use in contact with skin or tissue and said solvent is aqueous.

6. A package as claimed in claim 4 or 5 in which said solution contains 0.05 to 0.1% by weight of hydrogen peroxide.

* * * * *